United States Patent [19]

Cole et al.

[11] 4,018,571

[45] Apr. 19, 1977

[54] TREATMENT OF SOLID FUELS

[75] Inventors: Edward L. Cole, Fishkill; Howard V. Hess, Glenham, both of N.Y.

[73] Assignee: Texaco Inc., New York, N.Y.

[22] Filed: Feb. 20, 1975

[21] Appl. No.: 551,486

[52] U.S. Cl. ..... 44/1 R; 44/1 G; 44/6; 44/24

[51] Int. Cl.[2] ..... C10L 9/00; C10L 5/14

[58] Field of Search ..... 44/1 R, 1 G, 6, 16 D, 44/20, 24; 241/17

[56] References Cited

UNITED STATES PATENTS

| | | | |
|---|---|---|---|
| 1,479,757 | 1/1924 | Trent | 44/6 |
| 1,508,617 | 9/1924 | Schoch | 44/1 G |
| 1,960,917 | 5/1934 | Nagelvoort | 44/6 |
| 2,830,769 | 4/1958 | Work | 241/17 X |
| 3,660,054 | 5/1972 | Rieve | 44/1 R |
| 3,673,080 | 6/1972 | Schlinger et al. | 44/20 X |

*Primary Examiner*—Carl F. Dees

*Attorney, Agent, or Firm*—Thomas H. Whaley; Carl G. Ries; Robert Knox, Jr.

[57] ABSTRACT

Low rank solid fuels are upgraded by heating a mixture of particulate fuel and water to a temperature between 300° F. and the critical temperature of water under a pressure sufficient to maintain substantially all of the water in liquid state, cooling the mixture and separating the particles from the water by agglomeration with a hydrocarbon liquid.

11 Claims, No Drawings

TREATMENT OF SOLID FUELS

This invention relates to the upgrading of solid fuels. More particularly it is concerned with the beneficiation and agglomeration of low rank solid fuels such as subbituminous coal and lignite.

Millions of tons of low rank solid fuels exist in this country and although many of these deposits may be readily mined they are not used extensively as fuels because for the most part they are located at a great distance from the point of ultimate use and in addition they have several characteristics which make them less valuable as fuels. For example, these low rank fuels although generally they have a relatively low sulfur content still contain too much sulfur to permit their use as a fuel and yet meet the current regulations with respect to SO2 emissions. In addition, to make these coals economically attractive means must be found for separating the components of the coal having little or no heating value from the components having a high heating value. Thus, inorganic mineral matter, water and carbon-dioxide are desirably removed from such fuels to produce a fuel having a higher BTU per pound value and thereby produce a fuel which is more economic to transport either by rail or pipeline.

The bulk of the water in low rank solid fuels such as lignite and sub-bituminous coal may be removed by drying the fuel with a hot flue gas or a hot oil. However, the removal of ash-forming minerals from the low rank coals is difficult and ordinary beneficiation techniques such as jigging, tabling or sink-and-float techniques are not particularly efficient with the lower rank coals. Ash forming minerals generally occur in mined coals either as "segregated impurities" or as an inherent part of the coal. The segregated ash forming impurities are those that exist as individual discrete particles when the coal has been broken down. They are composed for the most part of shale, clay, sand, stone and other mineral material derived either from strata interbedded with the coal or from the roof and floor of the coal bed. Ordinarily they are removable by mechanical means. On the other hand, the term "inherent" or "fixed" ash is used to distinguish that part of the impurity in the coal which cannot be separated by mechanical means.

It has already been proposed to upgrade coals by agglomeration techniques. In these procedures the coal is first powdered and the powder is slurried in a liquid medium for example, water. A second liquid, usually a hydrocarbon, is then mixed with the slurry. The second liquid should be one which is immiscible with the first liquid but will selectively wet the highly carbonaceous material causing it to agglomerate into voluminous clusters that may be separated from the inorganic constituents which remain in the first liquid. However, in attempts to apply these procedures to deashing low rank solid fuels such as Lake DeSmet coal, the results were not encouraging.

According to our invention, a low rank solid fuel is upgraded by forming a slurry of said fuel with water, heating the slurry under super atmospheric pressure to a temperature between about 300° F. and the critical temperature of water, cooling the heated slurry, mixing with the slurry a hydrocarbon liquid in an amount between 1 and 100 parts by weight fuel per part liquid thereby forming solid fuel hydrocarbon agglomerates and separating said agglomerates from said water.

The solid fuels to which the process of our invention may be applied are the low rank solid fuels classified as sub-bituminous and lignite at page 57 of the Annual Book of ASTM Standards, 1973 Edition, Part 19. For the preparation of the slurry, the solid fuel should be reduced to a particulate form in which the particles have a maximum dimension of less than one inch, preferably, a maximum dimension of less than one-half inch and still more preferably less than one-quarter inch. The water and the particulate solid fuel are mixed in an amount to provide a mixture containing from about 0.5 to 6 parts water, preferably from 1 to 4 parts water per part fuel on a dry basis by weight. If the process is of the batch type the coal and water may be charged separately to a reaction zone such as an autoclave or they may be charged together as a slurry. In such latter event, the water should be present in the slurry in an amount between about 40 and 75% by weight, preferably between 40 and 60% by weight as, if the water content is less than about 40%, the slurry becomes difficult to pump.

The water treatment of the solid fuel should be carried out under non-oxidizing conditions and therefore air or other free oxygen containing gas should be removed from the heating zone. This may be done prior to the introduction of the water and solid fuel by sweeping the heating chamber with an inert gas such as reducing gas, steam or nitrogen and introducing the water and coal into the heating chamber under a blanket of the inert gas. Alternatively the reactants may be charged to the heating zone and then the gas sweep made to provide the inert atmosphere.

After the free oxygen has been removed from the heating zone, the coal-water mixture is heated to a temperature between about 300° F. and 750° F., preferably between 400° and 650° F. The pressure in the heating zone should be such that at least a substantial portion of the water remains in liquid state. In a preferred embodiment, the heating zone is swept with nitrogen and after the water and coal have been introduced therein, the heating zone is pressured to about 50 to 100 psig with nitrogen and then heated to a desired temperature under autogenous pressure. Generally, the pressure will not exceed about 2000 psig.

The time at temperature may range from 1 minute to about 5 hours, a preferred range being from 5 minutes to 4 hours. Although some upgrading of the solid fuel is obtained at shorter time intervals of less than 5 minutes, for practical reasons it is more desirable to maintain the coal and water at the designated temperature for a period of at least 5 minutes. After the heating has been completed, the slurry of coal and water is cooled to ambient temperature and the coal is then subjected to grinding to convert the particles to a finely divided state.

The grinding of the solid fuel is effected by any suitable equipment which may be selected from the various types described at pages 8–14 to 8–43 of Perry's Chemical Engineers Handbook, 4th edition. The solid fuel may be ground as a water slurry directly after its removal from the heating zone, although in a preferred embodiment the fuel is separated from the water used for the heat treatment and reslurried with fresh water and then ground. Advantageously the slurry will contain approximately 10% solids so that if the slurry from the heat treatment is introduced directly into the grinding equipment it may be necessary to add sufficient water to provide a slurry having the desired solids content. Not only does the heat treatment in the presence of water beneficiate the fuel in that its heating value is increased but additionally the fuel is more amenable to grinding due to this heat treatment.

After the grinding has been completed, the slurry is removed from the grinding device and the powdered fuel is agglomerated by being brought into intimate contact with a hydrocarbon liquid. The mixing of the slurry and the hydrocarbon may be effected continuously by bringing a flowing stream of the slurry into contact with a flowing stream of the hydrocarbon liquid or the mixing may be carried out as batch process in which the slurry and the hydrocarbon liquid are introduced into a mixing vessel and subjected to moderate agitation. The mixing may be carried out at any temperature below the boiling point of either the water or the hydrocarbon liquid and is preferably carried out at ambient conditions.

Any hydrocarbon liquid may be used for the agglomeration of the solid fuel particles. The liquid may be a pure hydrocarbon compound e.g., benzene, xylene, toluene or a mixture of hydrocarbon compounds e.g., petroleum naphtha, kerosene, catalytically cracked cycle gas oil and the like. It need not necessarily be purely hydrocarbon but may contain small amounts of impurities such as sulfur or nitrogen-containing compounds. The amount of hydrocarbon liquid used to form the agglomerates will vary depending on the physical characteristics of the coal particles and the range may fall between about 1 to 100 parts of dry coal by weight per part of hydrocarbon. The exact amount may be determined by sampling the ground slurry and adding hydrocarbon liquid to the sample gradually in small amounts with intermediate shaking until sufficient hydrocarbon liquid has been added to cause the desired agglomeration.

The following examples are submitted for illustrative purposes only. The charge is a Wyoming subbituminous coal having the following analyses.

TABLE 1

| Proximate Analysis | Wt. % |
|---|---|
| Moisture, % | 19.5 |
| Ash, % | 28.4 |
| Volatile Matter, % | 28.3 |
| Fixed Carbon, % | 23.8 |
| Sieve (U.S. Standard) | |
| +10 | 24.8 |
| −10+20 | 31.0 |
| −20+30 | 11.8 |
| −30+40 | 10.9 |
| −40+60 | 6.8 |
| −60+100 | 7.4 |
| Pan | 7.2 |

EXAMPLE I 200 grams of the coal was ball-milled with 150 grams of water for about 18 hours. The slurry was removed and the mill washed with 1300 ml of distilled water which was added to the slurry. 500 ml of this slurry was introduced into a vessel with about 12 ml xylene and the mixture stirred for 5 minutes. The contents were quickly transferred to a sieve array and the water allowed to drain into the pan. The various fractions were recovered for drying and analysis.

EXAMPLE II

This example is a substantial duplicate of Example I, the difference being that 10 ml of xylene was used for agglomeration.

EXAMPLE III 275 grams of coal and 600 ml. of distilled water are introduced into an autoclave. After being swept with nitrogen, the autoclave is sealed and pressured to about 100 psig with nitrogen and then heated to 600° F. at which temperature it is held for 4 hours under an autogenous pressure of about 2000 psig. The autoclave is then cooled to room temperature and vented. The product is then dried, mixed with an equal weight of distilled water and ball-milled for about 18 hours. Sufficient water is added to make a 10% slurry. The slurry is then introduced into a mixing vessel with xylene in an amount equal to a 4.2:1 coal to xylene weight ratio and stirred for 5 minutes. The contents are then transferred to a sieve array and allowed to drain into the pan. The various fractions are recovered for drying and analysis.

EXAMPLE IV

This example is a substantial duplicate of Example III, the difference being that the coal to xylene weight ratio is 5.5 to 1.

Data for Examples I–IV are tabulated below:

TABLE 2

| Example | I | | | II | | | III | | | IV | | |
|---|---|---|---|---|---|---|---|---|---|---|---|---|
| Coal:xylene, wt. | 4.2 | | | 5.5 | | | 4.2 | | | 5.5 | | |
| Screen, Mesh | 40 | 100 | Pan | 40 | 100 | Pan | 40 | 100 | Pan | 40 | 100 | Pan |
| Dry Coal in Sample, wt. % | 10.3 | 8.0 | 6.2 | 24.3 | 23.8 | 8.9 | 13.3 | 22.2 | 2.8 | 14.4 | 20.4 | 3.8 |
| Coal Retained Dry, wt. % | 0.7 | 13.1 | 86.2 | 2.0 | 9.8 | 88.2 | 9.4 | 69.3 | 21.2 | 7.9 | 63.5 | 28.5 |
| Ash, wt. % | 26.8 | 25.4 | 26.5 | 25.4 | 22.0 | 26.1 | 22.7 | 30.5 | 37.6 | 25.2 | 29.8 | 36.9 |
| C, wt. % | 49.2 | 50.5 | 50.8 | 49.8 | 47.6 | 49.6 | 59.1 | 49.0 | 40.1 | 58.6 | 52.5 | 41.3 |
| S, wt. % | 1.7 | 1.28 | | 1.8 | | 1.2 | | 1.2 | 1.2 | | 1.23 | 1.26 |
| HV,* BTU/lb. | 8412 | 7900 | 8535 | 8029 | 7936 | 8100 | | 8959 | 7728 | | 8903 | 7927 |

*Heating Value

These data show that in both Examples I and II there was little agglomeration as evidenced by the fact that the bulk of the coal and liquid was recovered on the pan. As a consequence there is no indication of enrichment of any significant fraction, either in heat content, ash or carbon. However, in Examples III and IV where the fuel was subjected to a preliminary heat and water treatment, it can be seen that substantial agglomeration did occur. In Example I, 86.2% of the coal (dry) was found in the pan whereas in Example III, 21.2% of the coal (dry) was found in the pan. Additionally, there was an enrichment in respect to the heating value, ash and carbon concentration when the fuel was subjected to the preliminary heat and water treatment. In Examples I and II, the high heat value material was not agglomerated and was found in the pan whereas in Examples III and IV the high heat value material was agglomerated and retained on the sieve and the low heat value material was found in the pan.

Various modifications of the invention as hereinbefore set forth may be made without departing from the spirit and scope thereof, and therefore, only such limitations should be made as are indicated in the appended claims.

We claim:

1. A process for upgrading a low rank solid fuel which comprises forming a slurry of said fuel with water, heating the slurry under super atmospheric pressure to a temperature between about 300° F. and the critical temperature of water, cooling the heated slurry, mixing with the slurry a hydrocarbon liquid in an amount between about 4 and 5 parts by weight fuel per part liquid thereby forming solid fuel-hydrocarbon agglomerates and separating said agglomerates from said water.

2. The process of claim 1 in which the temperature is between 400° and 650° F.

3. The process of claim 1 in which the slurry is maintained at said temperature for a period of time between 1 minute and 5 hours.

4. The process of claim 3 in which the time is between 5 minutes and 4 hours.

5. The process of claim 1 in which the heat treatment of the slurry is carried out in an inert atmosphere.

6. The process of claim 5 in which the inert atmosphere is supplied by nitrogen.

7. The process of claim 1 in which the low rank solid fuel is sub-bituminous coal.

8. The process of claim 1 in which the low rank solid fuel is lignite.

9. The process of claim 1 in which the slurry contains between 0.5 and 6 parts water by weight per part of dry fuel.

10. The process of claim 9 in which the slurry contains between 1 and 4 parts water by weight per part of dry fuel.

11. The process of claim 1 in which, after the heat treatment, the fuel is subjected to grinding in a slurry prior to the agglomeration step.

* * * * *